US007520381B2

(12) United States Patent
Bucalo

(10) Patent No.: US 7,520,381 B2
(45) Date of Patent: Apr. 21, 2009

(54) COUNTER STANDEE DISPLAY FOR OPEN STOCK CONTAINER

(75) Inventor: Carmine Bucalo, Allentown, PA (US)

(73) Assignee: Packaging Corporation of America, Lake Forest, IL (US)

( * ) Notice: Subject to any disclaimer, the term of this patent is extended or adjusted under 35 U.S.C. 154(b) by 220 days.

(21) Appl. No.: 11/175,867

(22) Filed: Jul. 6, 2005

(65) Prior Publication Data

US 2007/0007166 A1 Jan. 11, 2007

(51) Int. Cl.
*B65D 5/52* (2006.01)

(52) U.S. Cl. ..... 206/45.25

(58) Field of Classification Search ... 206/45.24–45.26, 206/730–735, 738–739, 745–750, 45.21
See application file for complete search history.

(56) References Cited

U.S. PATENT DOCUMENTS 1,131,075 A * 3/1915 O'Donnell ..... 206/45.24
1,382,979 A * 6/1921 Horr ..... 206/45.25
1,442,067 A * 1/1923 Horr ..... 206/45.21
1,590,044 A * 6/1926 List ..... 206/750
1,770,618 A * 7/1930 Lambert ..... 206/750
1,942,537 A * 1/1934 Coleman ..... 206/747
1,986,101 A * 1/1935 Brodsky ..... 206/738
2,142,883 A * 1/1939 Chaney et al ..... 206/738
2,175,513 A * 10/1939 Bauman ..... 206/45.25
5,007,530 A * 4/1991 Weismantel ..... 206/45.21

* cited by examiner

*Primary Examiner*—Bryon P Gehman
(74) *Attorney, Agent, or Firm*—Nixon Peabody LLP

(57) ABSTRACT

A display container comprises a first section and a second section hingedly connected to the first section. The first section has a front panel, a back panel, a first side panel that bridges the front panel and the back panel, a second side panel that bridges the front panel and the back panel, a top portion, and a bottom portion. The front panel has an access opening provided therein. The top portion is adapted to receive an open stock container. The second section has a front panel, a back panel, a first side panel that bridges the front panel and the back panel, and a second side panel that bridges the front panel and the back panel. The second section is adapted to stabilize the display container on a surface.

43 Claims, 10 Drawing Sheets

COUNTER STANDEE DISPLAY FOR OPEN STOCK CONTAINER

FIELD OF THE INVENTION

The present invention relates generally to containers for retaining, protecting and displaying goods and methods for making such containers. In particular, the present invention relates to a counter standee display container.

BACKGROUND OF THE INVENTION

Flat sheets of corrugated paperboard, typically referred to as blanks, have been used for many years as the starting material to form containers. Corrugated paperboard generally refers to a multi-layer sheet material comprised of two sheets of liner bonded to a central corrugated layer of medium. Given a basic size requirement specified by the customer, industry standards, and the preference for low cost, paperboard container manufacturers strive to provide structural stacking strength with a minimal amount of corrugated paperboard. A typical well-known container is a single-piece tray design having a bottom wall, two side walls and two end walls each hinged to the bottom wall. Typically, a single piece of corrugated paperboard will be cut and scored to form a flat blank that will then be erected into this container.

In displaying goods, particularly in a retail setting, it is desirable to have a container that is easy to pack, sturdy, aesthetically pleasing, and allows for efficient material distribution. For example, it is beneficial to have a container that allows a customer at a retail site to easily reach into the container and remove products for purchase. In such an application, it is desirable to have a printed area on the container that advertises or identifies the product. It is also beneficial to provide a container that accepts a product in a typical open stock container packaging, thus allowing the product manufacturer the flexibility of using a display container without the need to have a specifically designed packaging container for the product.

Thus, it would be desirable to provide a display container for the display of goods that can be easily manufactured on standard manufacturing and erecting equipment, and which further provides for easy alteration for display at retail and for convenient consumer access to the container contents. It would be further desirable to allow for the easy insertion of a typical open stock product container into the display container.

SUMMARY OF THE INVENTION

According to one embodiment of the present invention, a display container comprises a first section and a second section hingedly connected to the first section. The first section has a front panel, a back panel, a first side panel that bridges the front and the back panels, a second side panel that bridges the front and the back panels, a top portion, and a bottom portion. The front panel has an access opening provided therein. The top portion is adapted to receive an open stock container. The second section has a front panel, a back panel, a first side panel that bridges the front and the back panels, and a second side panel that bridges the front and the back panels. The second section is adapted to stabilize the display container on a surface.

According to another embodiment of the present invention, a display container assembly comprises a display container that has a first section and a second section, and an open stock container. The first section of the display container has a front panel, a back panel, a first side panel that bridges the front and the back panels, a second side panel that bridges the front and the back panels, a top portion, and a bottom portion. The front panel has an access opening provided therein. The top portion is adapted to receive the open stock container. The second section is hingedly connected to the first section. The second section has a front panel, a back panel, a first side panel that bridges the front and the back panels, and a second side panel that bridges the front and the back panels. The second section is adapted to stabilize the display container on a surface. The open stock container is adapted for positioning within the top portion of the first section of the display container. The open stock container holds a product. The product is accessible through the access opening of the front panel of the first section.

According to a further embodiment of the present invention, a display container comprises a first section, a second section, and a third section. The first section has a front panel, a back panel, a first side panel that bridges the front and the back panels, a second side panel that bridges the front and the back panels, a top portion, and a bottom portion. The front panel has an access opening provided therein. The top portion is adapted to receive an open stock container. The second section is hingedly connected to the first section. The second section has a front panel, a back panel, a first side panel that bridges the front and the back panels, and a second side panel that bridges the front and the back panels. The second section is adapted to stabilize the display container on a surface. The third section is hingedly connected to the first section. The third section has a front panel, a back panel, a first side panel that bridges the front and the back panels, and a second side panel that bridges the front and the back panels. The third section is adapted to receive the open stock container.

According to yet another embodiment of the present invention, a display container assembly comprises a display container having a first section, a second section and a third section, and at least one open stock container. The first section has a front panel, a back panel, a first side panel that bridges the front and the back panels, a second side panel that bridges the front and the back panels, a top portion, and a bottom portion. The front panel has an access opening provided therein. The top portion is adapted to receive an open stock container. The second section is hingedly connected to the first section. The second section has a front panel, a back panel, a first side panel that bridges the front and the back panels, and a second side panel that bridges the front and the back panels. The second section adapted to stabilize the display container on a surface. The third section is hingedly connected to the first section. The third section has a front panel, a back panel, a first side panel that bridges the front and the back panels, and a second side panel that bridges the front and the back panels. The third section is adapted to receive the open stock container. The at least one open stock container is adapted for positioning within the top portion of the first section of the display container. The open stock container holds a product. The product is accessible through the access opening of the front panel of the first section.

According to yet a further embodiment of the present invention, a display container comprises a first section and a second section. The first section has a top portion adapted to receive an open stock container, a bottom portion, and an access opening provided therein. The second section is hingedly connected to the first section. The second section is adapted to stabilize a display the display container on a surface.

BRIEF DESCRIPTION OF THE DRAWINGS

Other advantages of the invention will become apparent upon reading the following detailed description and upon reference to the drawings in which.

Figure 1:
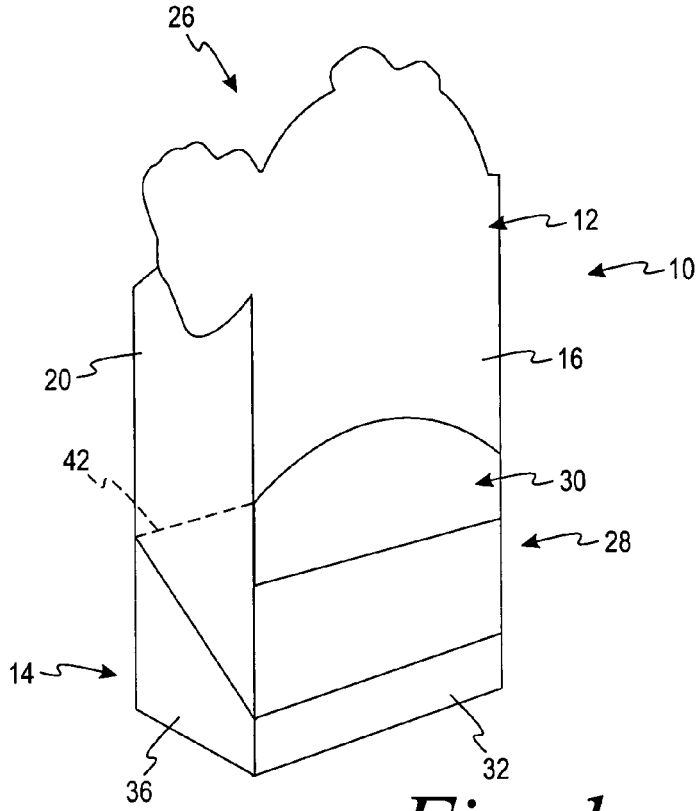
FIG. 1 is an isometric view of a display container according to one embodiment of the present invention.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Turning now to FIG. 1, a display container 10 according to the present invention is shown. The display container 10 is adapted to display and dispense the contents of an open stock container. An open stock container or carton is a container adapted to hold a plurality of items intended for sale that are shipped from a manufacturer to a retail location so that the items may be sold to a consumer. A non-limiting example of an open stock container is a box of candy bars that contains a plurality of individually wrapped candy bars intended for purchase by a consumer. It is contemplated that an open stock container may contain other food items, or non-food items. The display container 10 is adapted for easy conversion from a shipping configuration to a display and dispensing configuration. The display container 10 is adapted to be placed on a counter top, shelving at an appropriate height, or other structures.

According to one embodiment of the present invention, the display container 10 of FIGS. 1-5*b* comprises a first section 12 and a second section 14. The first section 12 has a front panel 16, a back panel 18 (FIG. 3), a first side panel 20, and a second side panel 22. The first side panel 20 bridges the front panel 16 and the back panel 18. The second side panel 22 bridges the front panel 16 and the back panel 18 opposite the first side panel 20. The front panel 16 has an access opening 24 (FIG. 3) adapted to allow access to an interior of the display container 10. The first section 12 additionally has a top portion 26 and a bottom portion 28. According to the embodiment shown in FIG. 1, the top portion 26 of the first section 12 further includes, a window panel 30. The window panel 30 is adapted to fold inward towards the interior of the display container 10 to form the access opening 24.

Figure 2:
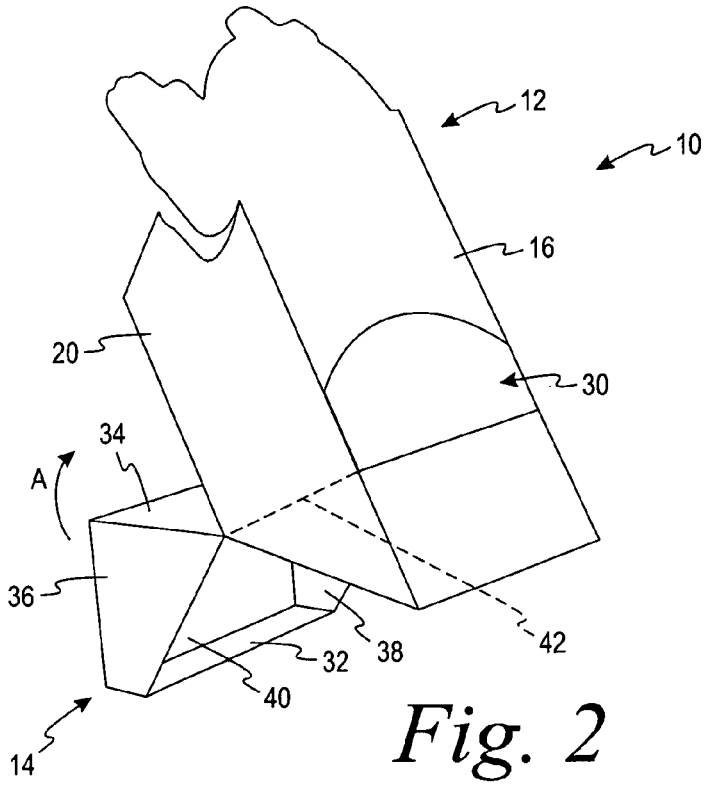
FIG. 2 is an isometric view of the display container of FIG. 1 in the process of being converted for display and distribution of a product.

The second section 14 of the display container 10 has a front panel 32, a back panel 34 (FIG. 2), a first side panel 36, a second side panel 38, and a bottom panel 40 (FIG. 2). The first side panel 36 bridges the front panel 32 and the back panel 34. The second side panel 38 bridges the front panel 32 and the back panel 34 opposite the first side panel 36.

Figure 3:
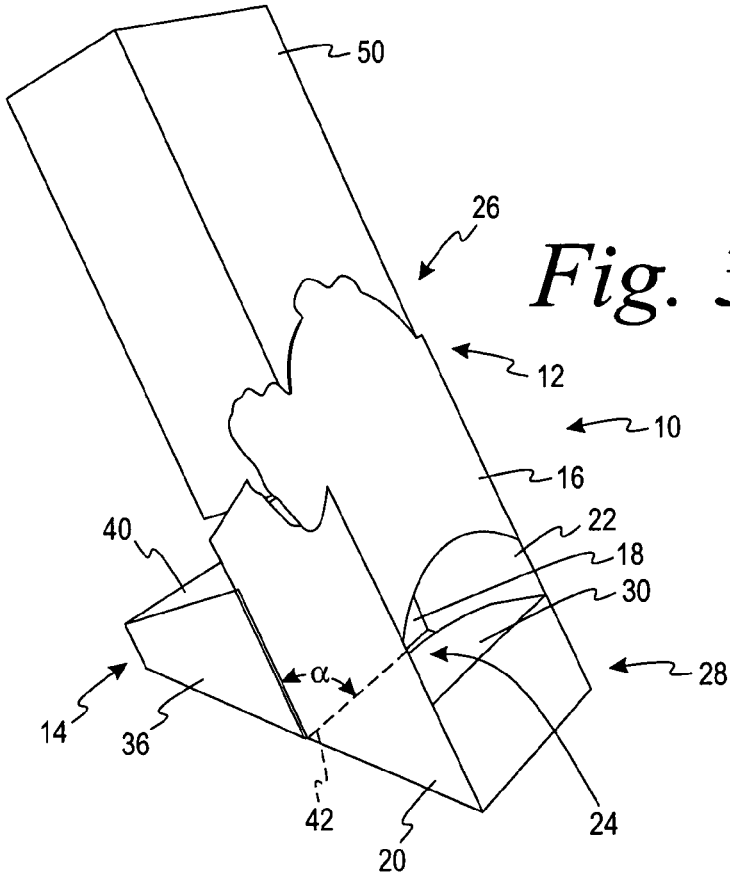
FIG. 3 is an isometric view of the display container of FIG. 1 in a display configuration adapted to receive an open stock container.

As shown in FIG. 2, the second section 14 is hingedly attached to the first section 12 along a hinge or fold line 42. The second section 14 is adapted to be rotated in the direction of arrow A along the fold line 42 until the back panel 34 of the second section 14 contacts the back panel 18 of the first section 12, as shown in FIG. 3. The second section 14 so positioned is adapted to support the display container 10 and provide stability to the display container 10.

Referring still to FIG. 3, an open stock container 50 is shown being inserted into the top portion 26 of the first section 12. The open stock container is adapted to contain a plurality of products to be dispensed from the display container 10, such as, for example, a candy bar. The open stock container 50 continues to be inserted into the display container 10 until the open stock container is substantially within the display container 10, as may be seen in FIG. 4. The access opening 24 of the front panel 16 of the first section 12 allows a user to access the open stock container 50. As shown in FIG. 3, the access opening 24 is formed by folding the window panel 30 of the first section 12 towards an interior of the first section 12. The window panel 30 thus forms a floor for supporting the open stock container 50, positioning the open stock container 50 relative to the access opening 24. According to one embodiment of the present invention, an angle a (FIG. 3) of from about eight-five degrees (85°) to about ninety-five degrees (95°) is formed between the window panel 30 folded towards the interior and the back panel 18 of the first section 12.

It is further contemplated that the access opening 24 is formed directly in the front panel 16 without the use of the window panel 30. In such an embodiment, the access opening 24 would be formed by removing material from the front panel 16, rather than by folding a panel towards the interior.

Figure 4:
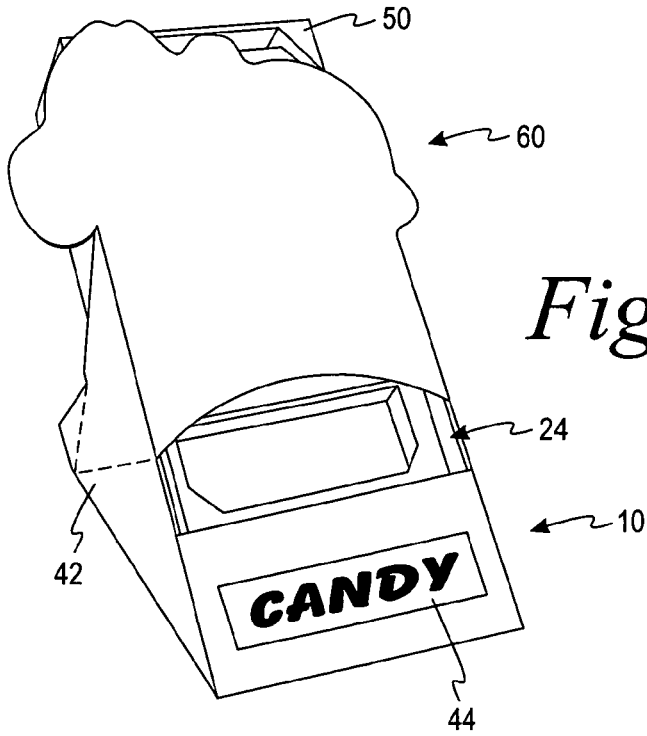
FIG. 4 is an isometric view of a display container assembly having the display container of FIG. 1 in a display configuration after receiving the open stock container.

As shown in FIG. 4, a display container assembly 60 is formed that comprises the display container 10 and the open stock container 50. The open stock container 50 is held within the first section 12 of the display container. The open stock container 50 is positioned relative to the access opening 24 of the display container such that a product within the open stock container is accessible through the access opening 24. For example, if the open stock container 50 is adapted to hold a plurality of candy bars, a consumer would be able to remove a candy bar from the open stock container 50 through the access opening 24 of the display container. It is further contemplated that the display container 10 may contain an advertising or information section 44, adapted to attract a consumer to the display container 10 and/or alert the consumer to features of the product within the open stock container 50. The advertising feature 44 shown in FIG. 4 is located on the bottom portion 28 of the front panel 16 of the first section 12. It is contemplated, however, that the advertising feature 44 may be located on the top portion 26 of the front panel 16, or the advertising feature 44 may be located on both the top portion 26 and the bottom portion 28.

As shown in FIGS. 1-4, the second section 14 is a glued snap-lock section, wherein panels forming the bottom panel 40 of the second section 14 are connected by an adhesive, as will be described further in connection with FIG. 5*a*.

Figure 5A:
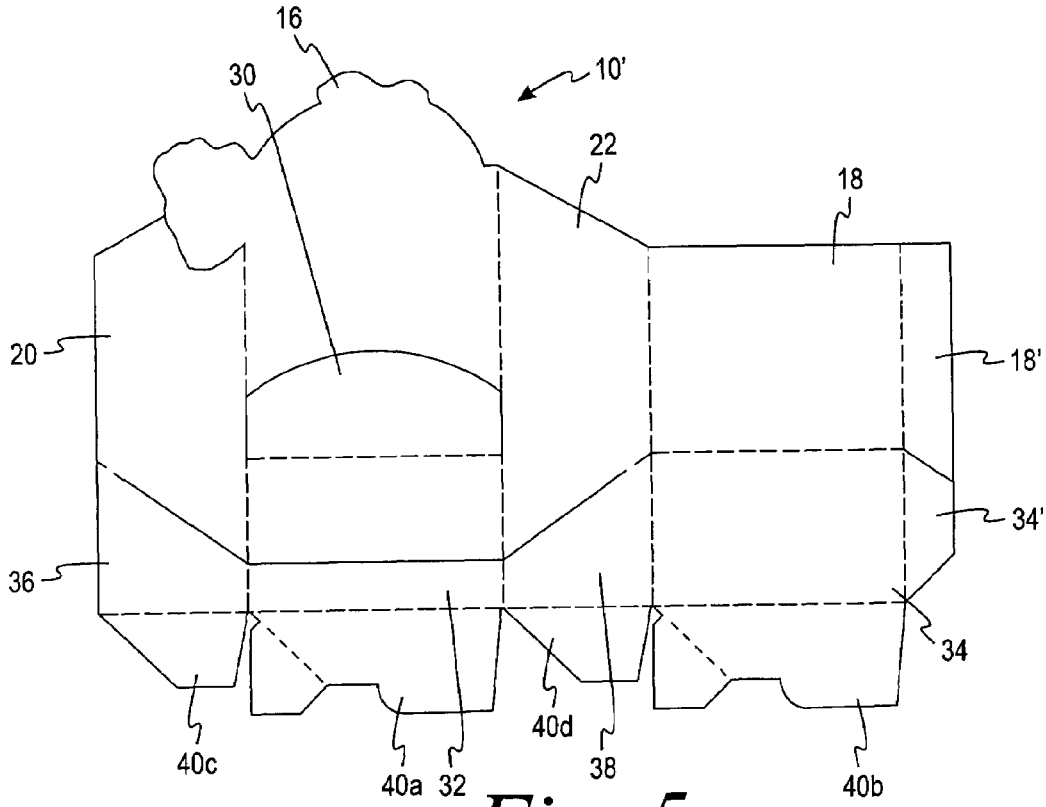
FIG. 5*a* is a plan view of the inner surface of a blank for forming the display container of FIG. 1.

Turning now to FIG. 5*a*, a plan view of a blank 10' for the formation of the display container 10 is shown. In addition to the panels previously described in connection with FIGS. 1-4, the blank 10' includes first, second, third, and fourth inner bottom flaps 40*a*-40*d*, respectively connected to the front panel 32, the back panel 34, the first side panel 36, and the second side panel 38 of the second section 14 along fold lines. The blank 10' additionally includes first and second section back panel assembly portions 18' and 34' adapted to connect the respective back panels 18, 34 to the respective first side panels 20, 36.

Figure 5B:
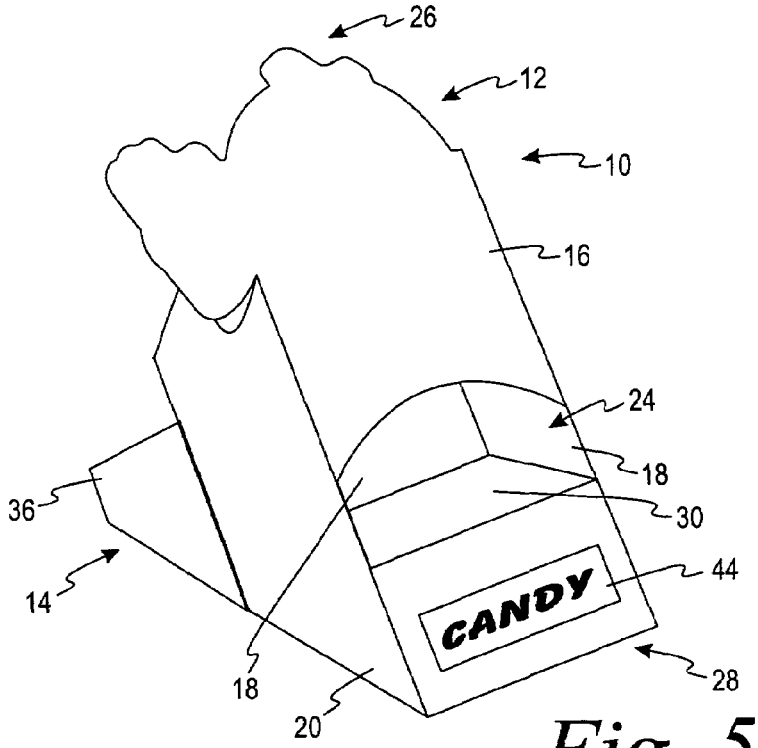
FIG. 5*b* is an isometric view of the display container of FIG. 1 in a display position.

To construct a display container 10 as shown in FIG. 5*b* from the blank 10', the panels are folded along fold lines so that the respective back panel assembly portions 18', 34' lay against the respective first side panels 20, 36 forming a generally rectangular container. An adhesive is used to secure the respective back panel assembly portions 18', 34' against the respective first side panels 20, 36. Next, the first, second, third, and fourth bottom panels 40*a*-40*d* are folded along fold lines to form the bottom panel 40. An adhesive is used to secure the first, second, third, and fourth bottom panels 40*a*-40*d* together. The window panel 30 is next folded inwardly to form the access opening 24. The second section 14 is then folded in the direction of arrow A as shown in FIG. 2, forming the display container 10.

Figure 6A:
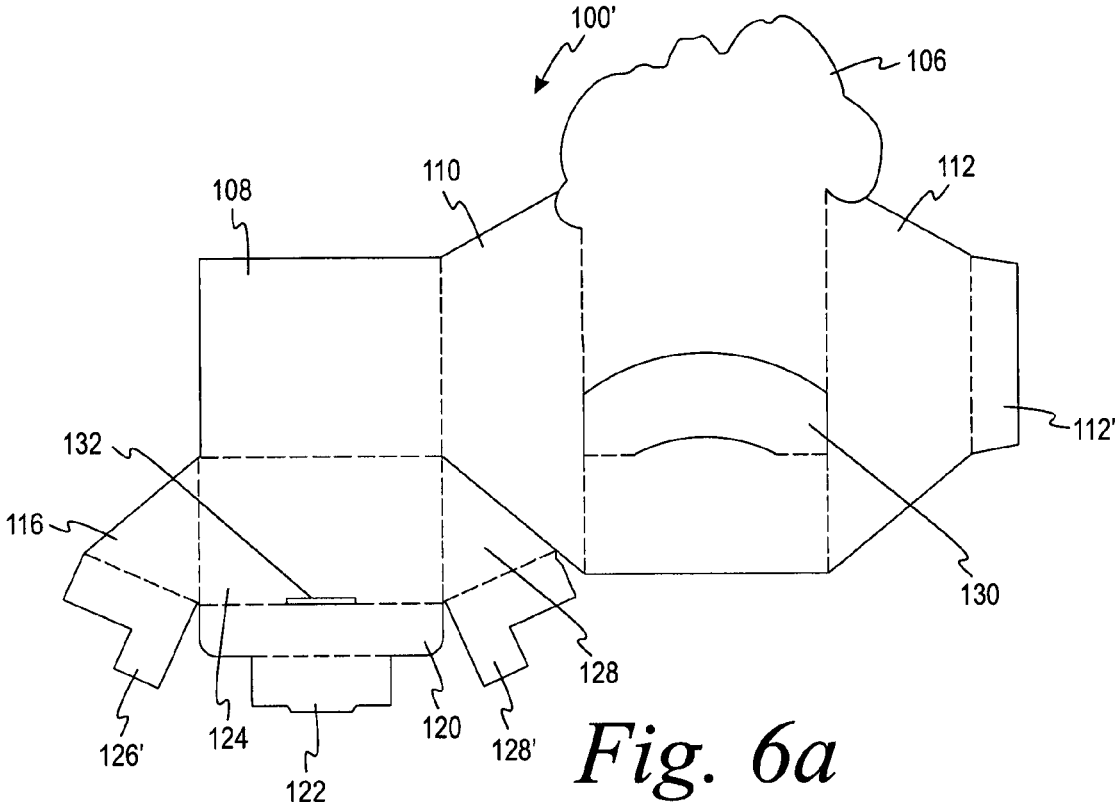
FIG. 6*a* is a plan view of the inner surface of an alternative blank for forming another embodiment of a displayable container according to the present invention.
Figure 6B:
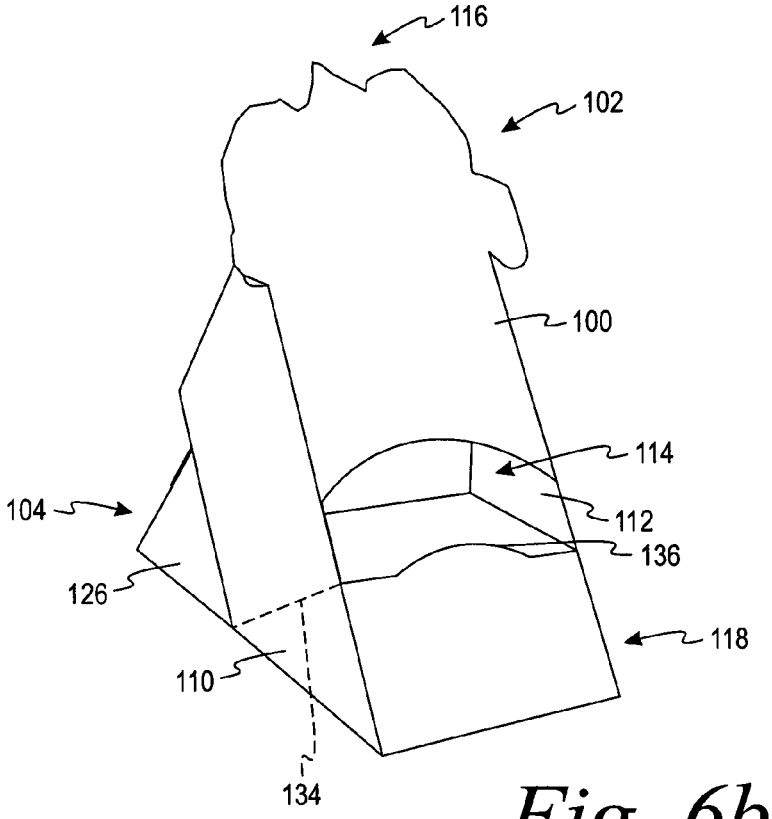
FIG. 6*b* is an isometric view of the container formed from the blank of FIG. 6*a*.

Turning now to FIG. 6*a*, another embodiment of a blank 100' is shown used to construct another display container 100 as shown in FIG. 6*b*. The display container 100 comprises a first section 102 and a second section 104. The first section 102 has a front panel 106, a back panel 108 (FIG. 7*b*), a first side panel 110, and a second side panel 112. The first side panel 110 bridges the front panel 106 and the back panel 108. The second side panel 112 bridges the front panel 106 and the back panel 108 opposite the first side panel 110. The front panel 106 has an access opening 114 adapted to allow access to an interior of the display container 100. The front panel 106 additionally includes a flow control tab 136 located at the access opening 114. The flow control tab is adapted to assist in maintaining a product within an open stock container used in conjunction with the display container 100. The first section 102 additionally has a top portion 116 and a bottom portion 118. According to the embodiment shown in FIG. 7*a*, the top portion 116 of the first section 102 further includes a window panel 130. The window panel 130 is adapted to fold inward towards the interior of the display container 100 to form the access opening 114.

Figure 7A:
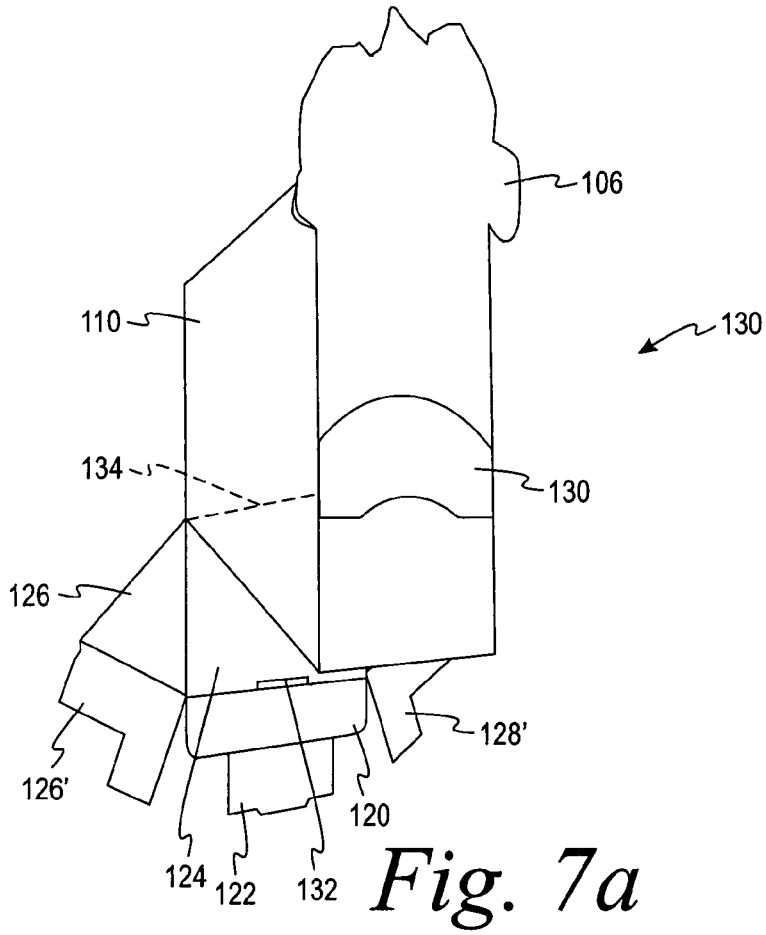
FIG. 7*a* is an isometric view of the container formed from the blank of FIG. 6*a* being further converted for display and distribution of a product.

The second section 104 of the display container 100 has a rollover panel 120, a locking tab 122, a back panel 124 (FIG. 7*a*), a first side panel 126, a second side panel 128 (FIG. 8*b*), and a locking slot 132 (FIG. 7*a*). The first side panel 126 additionally includes an interlocking tab portion 126'. The second side panel 128 additionally includes an interlocking tab portion 128'.

Figure 8A:
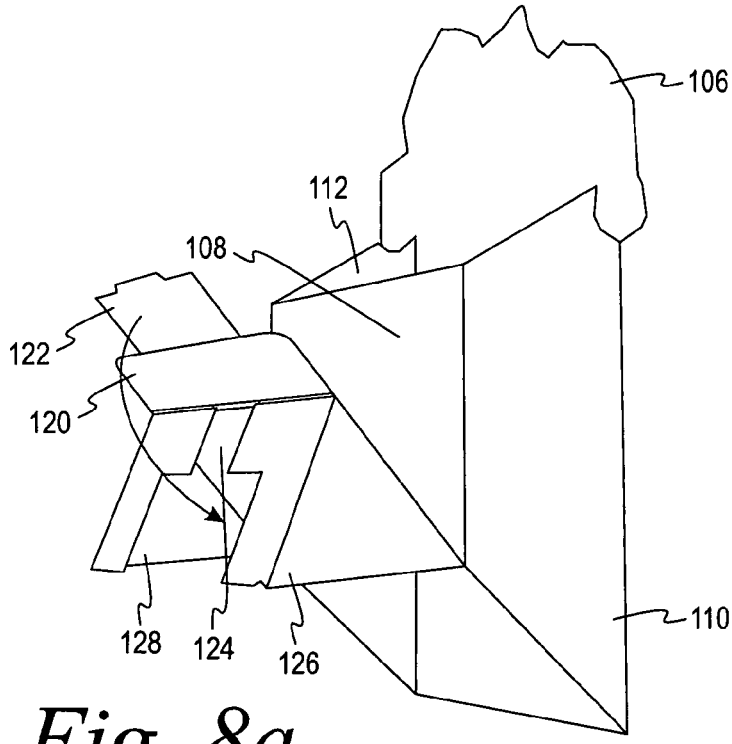
FIG. 8*a* is an isometric view of the container formed from the blank of FIG. 6*a* being further converted for display and distribution of a product.
Figure 8B:
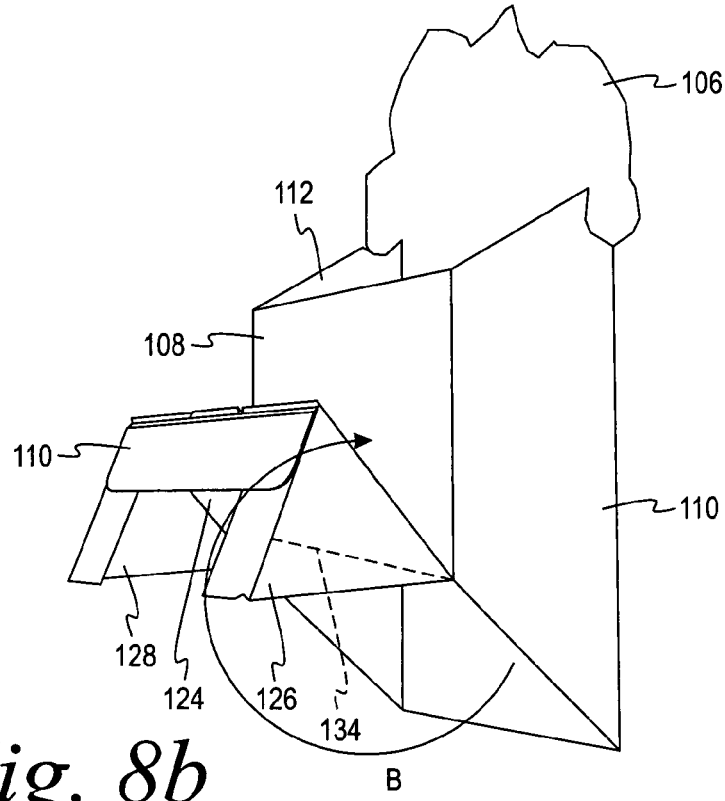
FIG. 8*b* is an isometric view of the container formed from the blank of FIG. 6*a* being further converted for display and distribution of a product.

As shown in FIG. 8*b*, the second section 104 is hingedly attached to the first section 102 along a hinge or fold line 134. The second section 104 is adapted to be rotated in the direction of arrow B along the fold line 134 until the back panel 124 of the second section 104 contacts the back panel 108 of the first section as shown in FIG. 6*b*.

As shown in FIG. 6*a*, the plan view of a blank 100' in addition to the panels previously described in connection with FIGS. 6*b*-8*b*, the blank 100' includes a first side panel tab portion 126', as well as a second side panel tab portion 128'. The blank 100' additionally includes second side panel assembly portion 112' adapted to connect the back panels 108 to the second side panel 112.

Figure 7B:
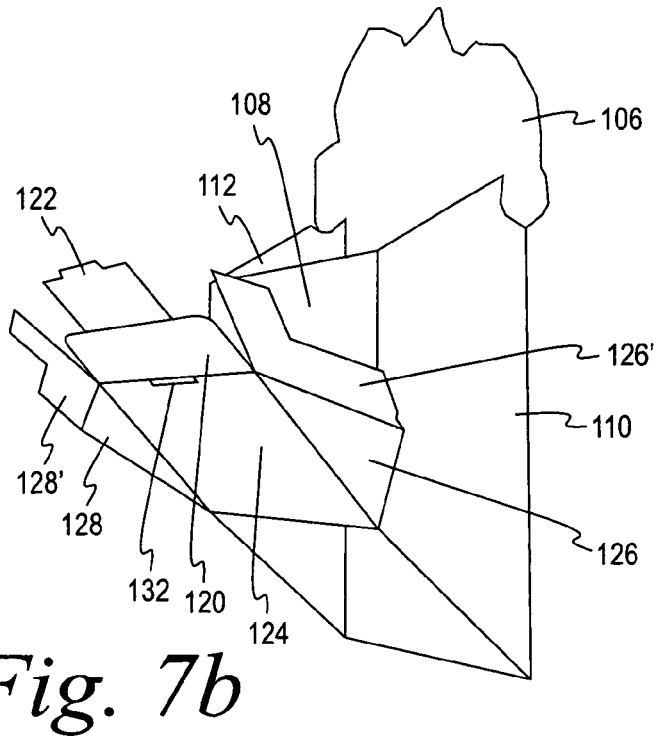
FIG. 7*b* is an isometric view of the container formed from the blank of FIG. 6*a* being further converted for display and distribution of a product.

To construct a display container 100 as shown in FIG. 6*b* from the blank 100', the panels are folded along fold lines so that the second side panel assembly portion 112' lays against the back panel 108, forming a generally rectangular container as shown in FIG. 7*a*. An adhesive is used to secure the second side panel assembly portion 112' to the back panel 108. Next, the back panel 124 is rotated about the fold line 134 as shown in FIG. 7*b*. Then, the side panels 126, 128 are folded towards the center of the display container 100, and the interlocking tab portions 126' 128' of the respective side panels 126, 128 are folded towards the front panel 106, as shown in FIG. 8*a*. The rollover panel 120 is folded towards the side panels interlocking tab portions 126', 128', and the tab 122 is inserted into the slot 132, as shown in FIG. 8*b*, finalizing the second section 104 of the container 100. The second section 104 is then rotated in the direction of arrow B until the back panel 124 of the second section 104 contacts the back panel 108 of the first section 102. The display container 100 is supported by the second section 104 to display and dispense a product.

Figure 10:
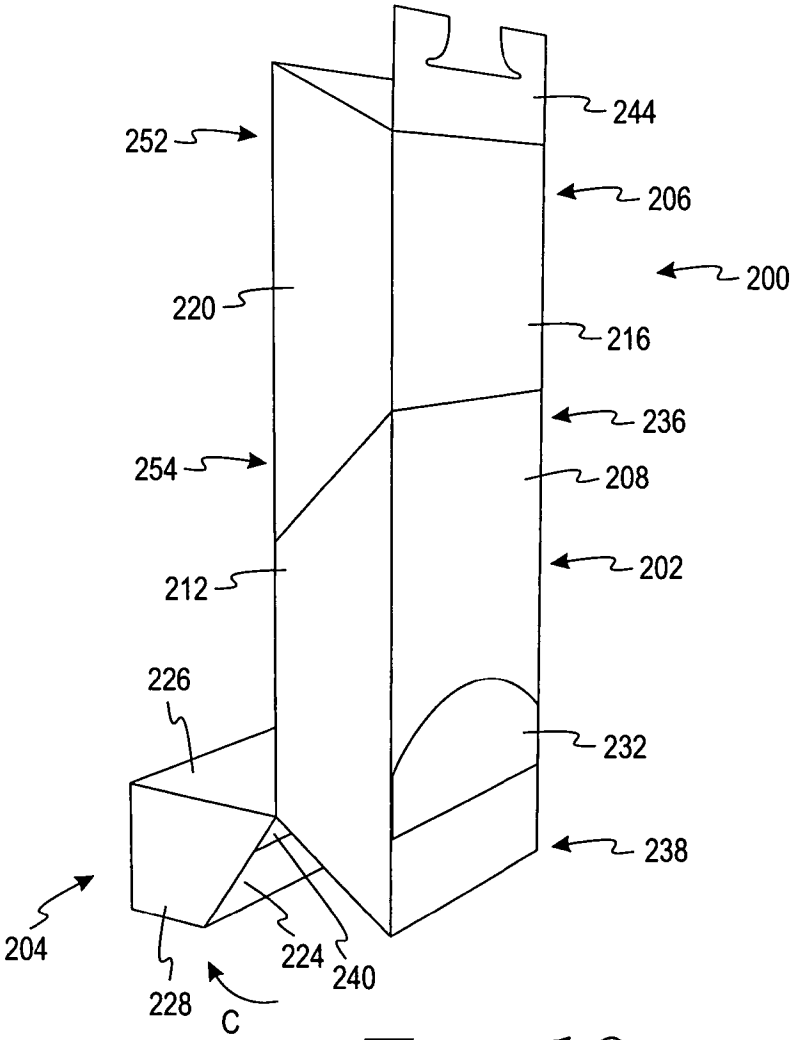
FIG. 10 is an isometric view of the container of FIG. 9 being converted for display and distribution of a product.
Figure 9:
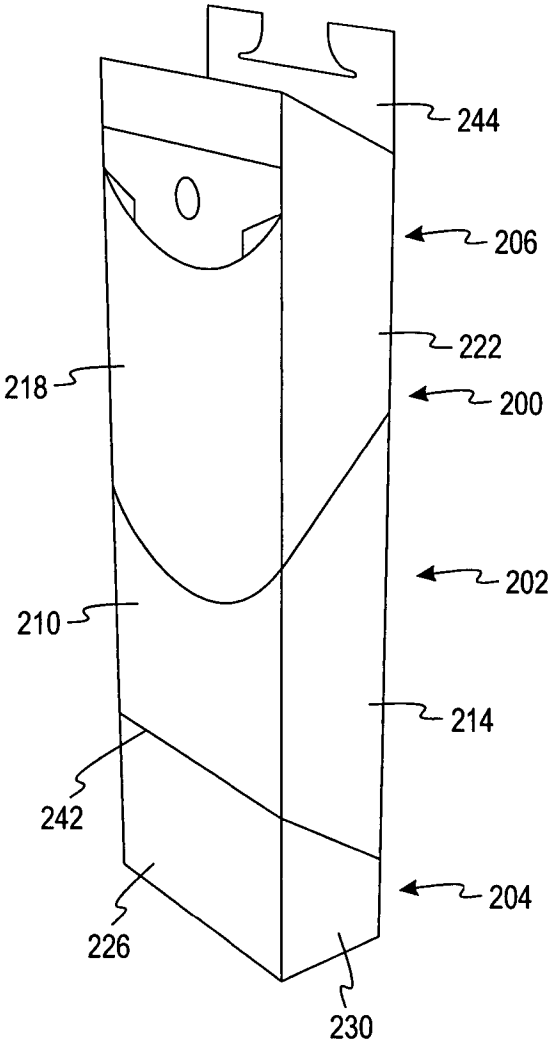
FIG. 9 is an isometric view of a display container according to a further embodiment of the present invention in a shipping position.

Turning now to FIGS. 9-16 a display container 200 is shown according to a further embodiment of the present invention. As shown in FIGS. 9-10, the display container 200 is adapted to display and dispense the contents of at least one open stock container. The display container 200 comprises a first section 202, a second section 204, and a third section 206. The first section 202 has a front panel 208, a back panel 210, a first side panel 212, and a second side panel 214. The first side panel 212 bridges the front panel 208 and the back panel 210. The second side panel 214 bridges the front panel 208 and the back panel 210 opposite the first side panel 212. The front panel 208 has an access opening 234 (FIG. 11) adapted to allow access to an interior of the display container 200. AS shown in FIG. 10, the first section 202 additionally has a top portion 236 and a bottom portion 238. According to the embodiment shown in FIG. 10, the top portion 236 of the first section 202 further includes a window panel 232. The window panel 232 is adapted to fold inward towards the interior of the display container 200 to form the access opening 234. According to one embodiment of the present invention, an angle of from about eight-five degrees (85°) to about ninety-five degrees (95°) is formed between the window panel 232 folded towards the interior and the back panel 210 of the first section 202.

The second section 204 of the display container 200 has a front panel 224, a back panel 226, a first side panel 228, a second side panel 230, and a bottom panel 240. The first side panel 228 bridges the front panel 224 and the back panel 226. The second side panel 230 bridges the front panel 224 and the back panel 226 opposite the first side panel 228.

The third section 206 of the display container has a front panel 216, a back panel 218, a first side panel 220, a second side panel 222, and a top panel 244. The first side panel 220 bridges the front panel 216 and the back panel 218. The second side panel 222 bridges the front panel 216 and the back panel 218 opposite the first side panel 220. The top panel 244 is hingedly connected to the front panel 216. The third section 206 has a first portion 252 and a second portion 254.

As shown in FIG. 10, the second section 204 is hingedly attached to the first section 202 along a fold line 242 (FIG. 9). The second section 204 is adapted to be rotated in the direction of arrow C along the fold line 242 until the back panel 226 of the second section 204 contacts the back panel 210 of the first section 202 as shown in FIG. 11.

Figure 12:
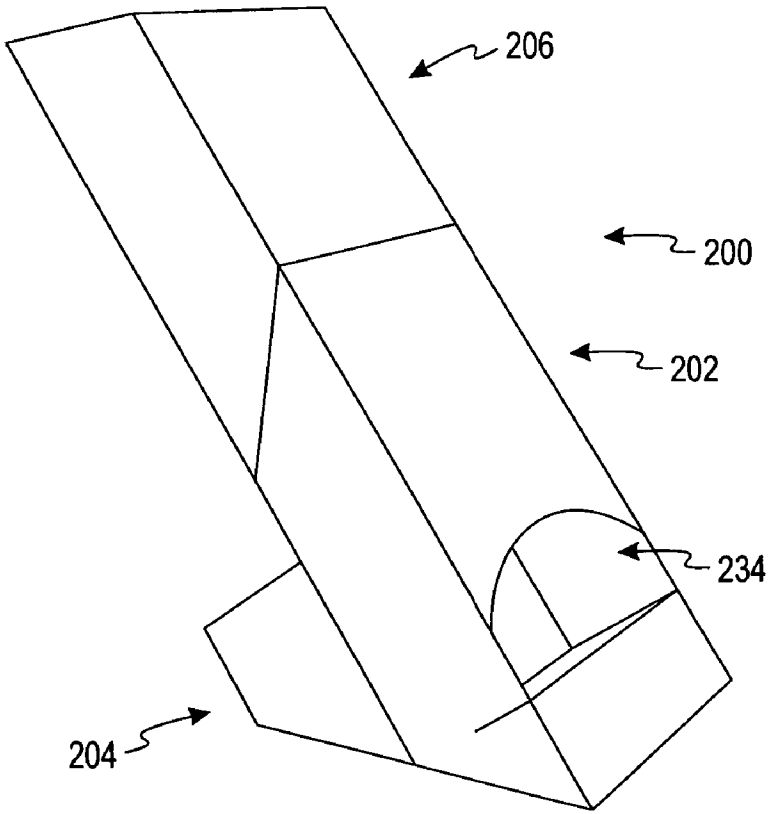
FIG. 12 is an isometric view of the container of FIGS. 9-11 in a first position for display and distribution of a product.
Figure 11:
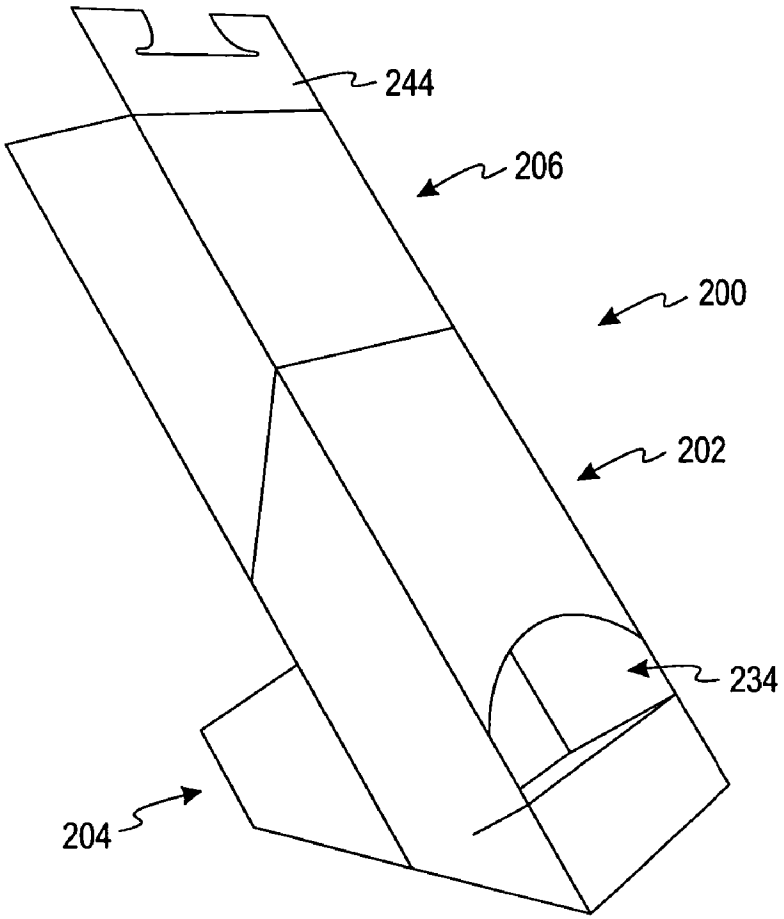
FIG. 11 is an isometric view of the container of FIGS. 9-10 being further converted for display and distribution of a product.

Turning now to FIG. 11, the display container 200 is shown in a first dispensing position. In the first dispensing position, the display container is adapted to receive an open stock container through first portion 252 of the third section 206 that will pass through second portion 254 of the third section 206 and be finally positioned within the first section 202, such that contents of the open stock container are accessible through the access opening 234. Once an open stock container is located within the first section 202, the top panel 244 of the third section is folded down towards the back panel 218 of the third section 206, as shown in FIG. 12, enclosing the open stock container. The display container 200 in the first position is adapted to dispense the contents of a single open stock container. The display container 200 is supported by the second section 204 to display and dispense a product.

Figure 14:
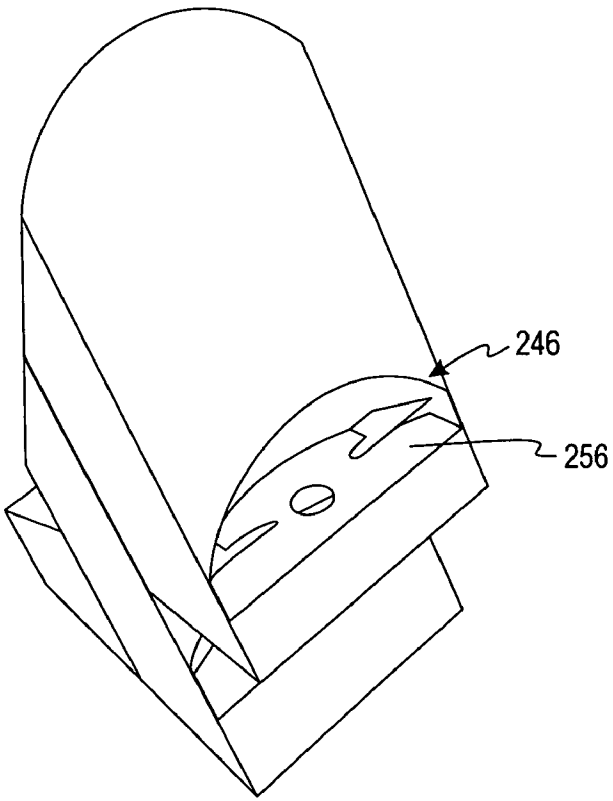
FIG. 14 is an isometric view of the container of FIGS. 9-13 being further converted to a second position for display and distribution of a product.
Figure 13:
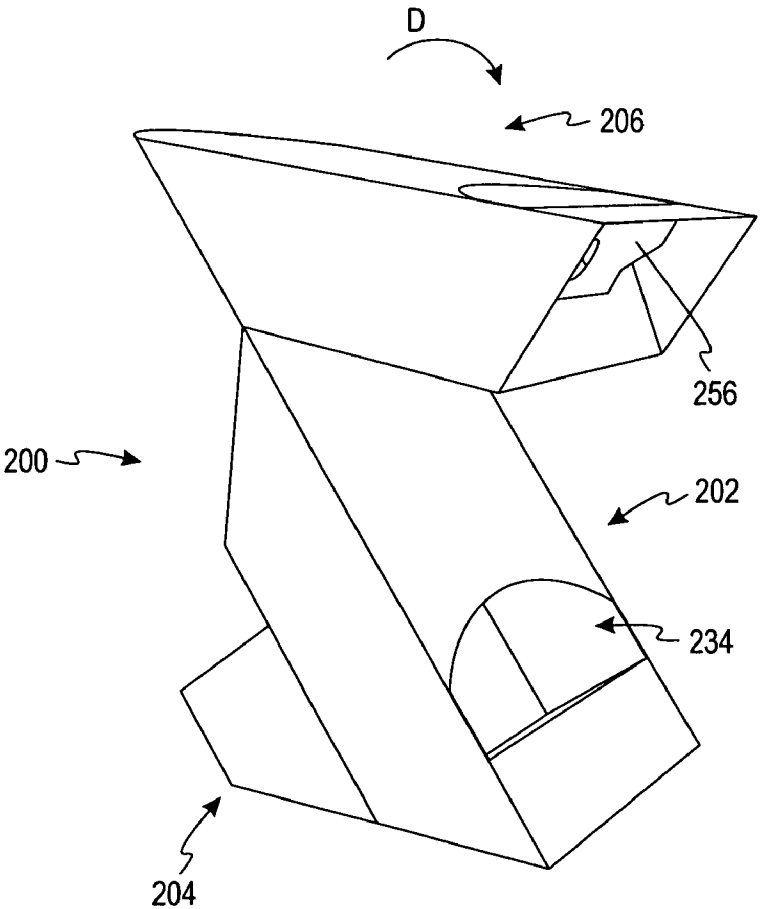
FIG. 13 is an isometric view of the container of FIGS. 9-12 being converted to a second position for display and distribution of a product.
Figure 16:
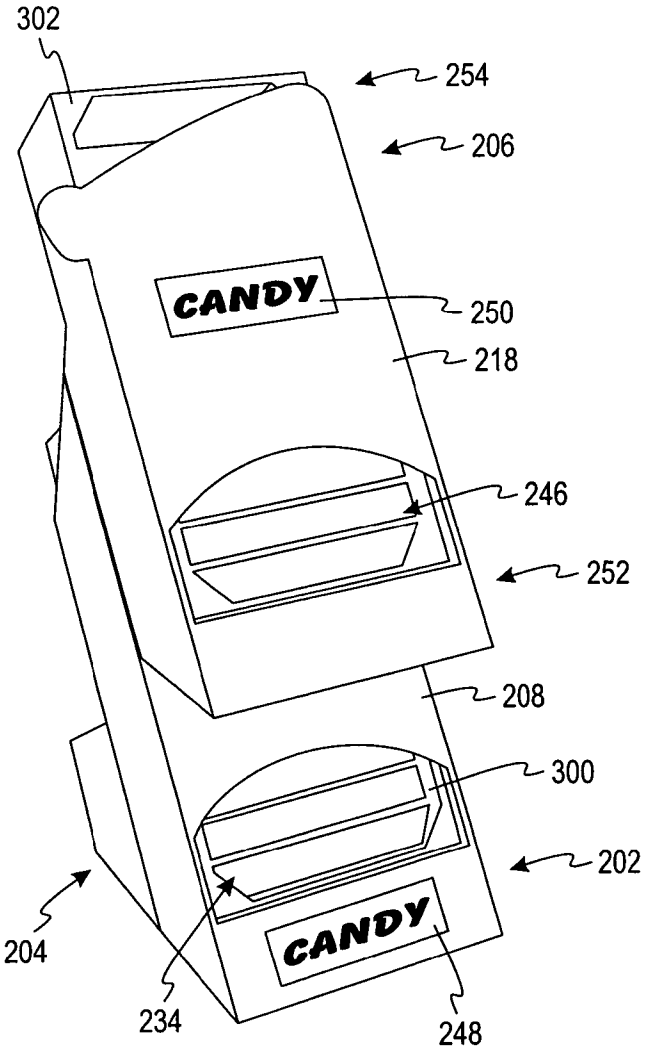
FIG. 16 is an isometric view of a container assembly having the container of FIG. 15 as well as two open stock containers.
Figure 15:
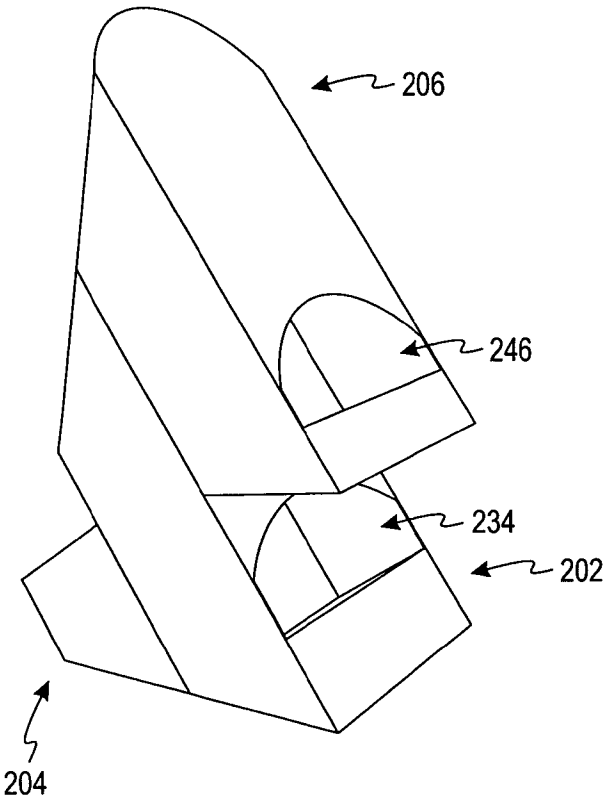
FIG. 15 is an isometric view of the container of FIGS. 9-14 in a second position for display and distribution of a product.

As shown in FIG. 13, the display container 200 may be converted from the first dispensing position to a second dispensing position. The third section 206 is rotated in the direction of arrow D towards the first section 202. The third section 206 rotates in the direction of arrow D until the front panel 216 of the third section 206 contacts the front panel 208 of the first section 202, as shown in FIGS. 14 and 15. When the display container 200 is in the second dispensing position, the third section 206 is additionally adapted to display and dispense the contents of a second open stock container. The third section 206 additionally has an access opening 246 in the first portion 252 adapted to provide access to an open stock container located in an interior of the third section 206, as well as a support panel 256 to provide support to an open stock container located in an interior of the third section 206. Thus, the display container 200 may dispense product from two open stock containers when in the second dispensing position as shown in FIG. 16, a first open stock container 300 is located within the first section 202, and a second open stock container 302 is located within the third section 206. The access opening 234 provides access to the first open stock container 300, while the access opening 246 provides access to the second open stock container 302. The open stock containers 300, 302 may contain food or non-food items for dispensing. The items dispensed from the open stock containers 300, 302 may be he same, or may be different.

As can be seen in FIG. 16, the display container 200 may additionally contain a first advertising or informational feature 248 on the first section 202. The first advertising feature 248 may be located on the bottom portion 238 of the front panel 208 of the first section 202. Additionally or alternatively the advertising feature 248 may be located on the top portion 236 of the first section 202. The display container 200 may additionally contain a second advertising or informational feature 250 on the third section 206. The second advertising feature 250 may be located on the back panel 218 of the third section 206, such that the second advertising feature 250 is displayed to a consumer when the display container 200 is in the second dispensing position, as shown in FIG. 16. It is further contemplated that the third section 202 may additionally contain a third advertising feature (not shown) on the front panel 216. The third advertising feature would be displayed to a consumer when the display container 200 is in the first dispensing position.

The display containers of the present invention are typically manufactured using corrugated paperboard, preferably with the corrugations running in a vertical direction for increased strength. It is to be understood that the principles of this invention could be applied to containers made of other materials, such as non-corrugated paperboards, cardboard, corrugated fiberboard, non-corrugated fiberboard, solid-fiber board, polymeric materials, and other foldable materials.

Although the embodiments of the display containers previously described and depicted contain generally rectangular cross sections, it is contemplated that the display containers of the present invention may have non-rectangular cross sections. It is contemplated that a display container may have a polygonal cross section, such as a triangle, square, hexagon, octagon, pentagon, or the like. It is further contemplated that a display container may have a non-polygonal cross section, such as a circle or an oval.

Thus, it is contemplated according to one alternative embodiment that a display container comprises a first section and a second section. The first section having a top portion adapted to receive an open stock container, a bottom portion, and an access opening provided therein. The first section having a generally polygonal cross section. The second section is hingedly connected to the first section. The second section is adapted to stabilize a display the display container on a surface. The second section having a generally polygonal cross section.

It is further contemplated according to another alternative embodiment that a display container comprises a first section and a second section. The first section having a top portion adapted to receive an open stock container, a bottom portion, and an access opening provided therein. The first section having a non-polygonal cross section. The second section is hingedly connected to the first section. The second section is adapted to stabilize a display the display container on a surface. The second section having a non-polygonal cross section.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A display container comprising:

a first section having a front panel, a back panel, a first side panel bridging the front panel and the back panel, a second side panel bridging the front panel and the back panel, the front panel having a top portion bridging the first side panel and the second side panel, a bottom portion bridging the first side panel and the second side panel, and an access opening provided between the top portion and the bottom portion, the first section being adapted to receive an open stock container; and a second section hingedly connected to the first section, the second section having a front panel, a back panel, a first side panel bridging the front panel and the back panel, a second side panel bridging the front panel and the back panel, the second section being adapted to stabilize the display container on a surface.

2. The display container of claim 1 wherein the first section further has a window panel, the window panel being foldable towards an interior of the first section thereby forming the access opening.

3. The display container of claim 2 wherein an angle formed between the window panel folded towards the interior and the back panel of the first section is from about eighty-five degrees to about ninety-five degrees.

4. The display container of claim 1 wherein the second section further has a bottom panel, the bottom panel bridging the front panel, the back panel, the first side panel and the second side panel.

5. The display container of claim 4 wherein the bottom panel is a glued panel.

6. The display container of claim 4 wherein the bottom panel is a rollover locking panel.

7. The display container of claim 4, wherein the front panel of the second section extends from the bottom panel of the second section.

8. The display container of claim 1 wherein the access opening has a tab adapted to assist in controlling flow of a product from an open stock container.

9. The display container of claim 1 wherein the first section and the second section comprise paperboard.

10. The display container of claim 1, wherein the top portion of the front panel of the first section extends above the back panel of the first section.

11. A display container assembly comprising:

a display container having a first section and a second section;

the first section having a front panel, a back panel, a first side panel bridging the front panel and the back panel, a second side panel bridging the front panel and the back panel, the front panel having a top portion bridging the first side panel and the second side panel, a bottom portion bridging the first side panel and the second side panel, and an access opening provided between the top portion and the bottom portion; and the second section hingedly connected to the first section, the second section having a front panel, a back panel, a first side panel bridging the front panel and the back panel, a second side panel bridging the front panel and the back panel, the second section stabilizing the display container on a surface; and an open stock container being positioned within the first section of the display container, the open stock container holding a product, the product being accessible through the access opening of the front panel of the first section.

12. The display container assembly of claim 11 wherein the first section further has a window panel, the window panel being foldable towards an interior of the first section thereby forming the access opening.

13. The display container assembly of claim 12 wherein an angle formed between the window panel folded towards the interior and the back panel of the first section is from about eighty-five degrees to about ninety-five degrees.

14. The display container assembly of claim 11 wherein the second section further has a bottom panel, the bottom panel bridging the front panel, the back panel, the first side panel and the second side panel.

15. The display container assembly of claim 14 wherein the bottom panel is a glued panel.

16. The display container assembly of claim 14 wherein the bottom panel is a rollover locking panel.

17. The display container of claim 14, wherein the front panel of the second section extends from the bottom panel of the second section.

18. The display container assembly of claim 11 wherein the access opening has a tab adapted to assist in controlling flow of a product from the open stock container.

19. The display container assembly of claim 11 wherein the display container comprises paperboard.

20. The display container of claim 11, wherein the top portion of the front panel of the first section extends above the back panel of the first section.

21. A display container comprising:

a first section having a front panel, a back panel, a first side panel bridging the front panel and the back panel, a second side panel bridging the front panel and the back panel, the front panel having a top portion bridging the first side panel and the second side panel, a bottom portion bridging the first side panel and the second side panel, and an access opening provided between the top portion and the bottom portion, the first section being configured to receive at least one open stock container;

a second section hingedly connected to the first section, the second section having a front panel, a back panel, a first side panel bridging the front panel and the back panel, a second side panel bridging the front panel and the back panel, and a bottom panel bridging the front panel, the back panel, the first side panel and the second side panel, the front panel of the second section extending from the bottom panel in a direction substantially parallel to the back panel of the second section, the second section stabilizing the display container on a surface.

22. The display container of claim 21 further comprising a third section, the third section hingedly connected to the first section, the third section having a front panel, a back panel, a first side panel bridging the front panel and the back panel, a second side panel bridging the front panel and the back panel, the third section being configured to receive at least one open stock container.

23. The display container of claim 22 wherein the third section is foldable from a first position to a second position along a hinged connection to the first section.

24. The display container of claim 23 wherein the third section in the first position has a first portion and a second portion, the first portion being configured to receive the at least one open stock container.

25. The display container of claim 23 wherein the third section in the second position has a first portion and a second portion, the second portion having a third section window panel, the third section window panel being foldable towards an interior of the third section so as to form an access opening.

26. The display container of claim 22 wherein the first section further has a first section window panel, the first section window panel being foldable towards an interior of the first section so as to form the access opening.

27. The display container of claim 26 wherein an angle formed between the first section window panel folded towards the interior and the back panel is from about eighty-five degrees to about ninety-five degrees.

28. The display container of claim 22 wherein the second section further has a bottom panel, the bottom panel bridging the front panel and the back panel and the first side panel and the second side panel.

29. The display container of claim 28 wherein the bottom panel is a glued panel.

30. The display container of claim 28 wherein the bottom panel is a rollover locking panel.

31. The display container of claim 22 wherein the access opening has a tab adapted to assist in controlling flow of a product from the at least one open stock container.

32. A display container assembly comprising:

a display container having a first section and a second section;

the first section having a front panel, a back panel, a first side panel bridging the front panel and the back panel, a second side panel bridging the front panel and the back panel, the front panel having a top portion bridging the first side panel and the second side panel, a bottom portion bridging the first side panel and the second side panel, and an access opening provided between the top portion and the bottom portion; and the second section hingedly connected to the first section, the second section having a front panel, a back panel, a first side panel bridging the front panel and the back panel, a second side panel bridging the front panel and the back panel, and a bottom panel bridging the front panel, the back panel, the first side panel and the second side panel, the front panel of the second section extending from the bottom panel in a direction substantially parallel to the back panel of the second section, the second section stabilizing the display container on a surface; and a first open stock container being positioned within the first section of the display container, the open stock container holding a product, the product being accessible through the access opening of the front panel of the first section.

33. The display container assembly of claim 32 wherein the display container further comprises a third section, the third section being hingedly connected to the first section, the third section having a front panel, a back panel, a first side panel bridging the front panel and the back panel, a second side panel bridging the front panel and the back panel, the third section receiving at least the first open stock container.

34. The display container assembly of claim 33 wherein the third section is foldable from a first position to a second position along a hinged connection to the first section.

35. The display container assembly of claim 33 wherein the third section in the first position has a first portion and a second portion, the first portion receiving at least the first open stock container.

36. The display container assembly of claim 33 wherein the third section in the second position has a first portion and a second portion, the second portion having a third section window panel, the third section window panel being foldable towards an interior of the third section so as to form an access opening.

37. The display container assembly of claim 33 wherein the access opening has a tab adapted to assist in controlling flow of the product from the at least one open stock container.

38. The display container assembly of claim 33 further comprising at least a second open stock container adapted for positioning within the third section of the display container when the third section is in the second position, the second open stock container holding a product, the product being accessible through the access opening of the third section.

39. The display container assembly of claim 32 wherein the first section further has a first section window panel, the first section window panel being foldable towards an interior of the first section so as to form the access opening.

40. The display container assembly of claim 39 wherein an angle formed between the first section window panel folded towards the interior and the back panel is from about eighty-five degrees to about ninety-five degrees.

41. The display container assembly of claim 32 wherein the second section further has a bottom panel, the bottom panel bridging the front panel and the back panel and the first side panel and the second side panel.

42. The display container assembly of claim 41 wherein the bottom panel is a glued panel.

43. The display container assembly of claim 41 wherein the bottom panel is a rollover locking panel.

* * * * *